US009510109B2

(12) United States Patent
Liu et al.

(10) Patent No.: US 9,510,109 B2
(45) Date of Patent: Nov. 29, 2016

(54) MEMS MICROPHONE DEVICE

(71) Applicants: Guojun Liu, Shenzhen (CN); Peng Zeng, Shenzhen (CN); Zhijiang Wu, Shenzhen (CN)

(72) Inventors: Guojun Liu, Shenzhen (CN); Peng Zeng, Shenzhen (CN); Zhijiang Wu, Shenzhen (CN)

(73) Assignee: AAC Acoustic Technologies (Shenzhen) Co. Ltd., Shenzhen (CN)

( * ) Notice: Subject to any disclaimer, the term of this patent is extended or adjusted under 35 U.S.C. 154(b) by 0 days.

(21) Appl. No.: 14/832,590

(22) Filed: Aug. 21, 2015

(65) Prior Publication Data

US 2016/0212549 A1 Jul. 21, 2016

(30) Foreign Application Priority Data

Jan. 20, 2015 (CN) ..... 2015 2 0038893 U

(51) Int. Cl.
*H04R 25/00* (2006.01)
*H04R 19/04* (2006.01)

(52) U.S. Cl.
CPC ..... *H04R 19/04* (2013.01); *H04R 2201/003* (2013.01)

(58) Field of Classification Search
CPC ..... H04R 19/005; H04R 2201/003
USPC ..... 381/173–175, 357, 369; 257/415, 416, 257/419; 29/594
See application file for complete search history.

(56) References Cited

U.S. PATENT DOCUMENTS

| | | | | |
|---|---|---|---|---|
| 7,868,402 | B2 * | 1/2011 | Huang | B81B 7/007 257/416 |
| 2010/0038733 | A1 * | 2/2010 | Minervini | B81B 7/0048 257/416 |
| 2015/0001648 | A1 * | 1/2015 | Lee | H04R 19/04 257/416 |

* cited by examiner

*Primary Examiner* — Sunita Joshi
(74) *Attorney, Agent, or Firm* — Na Xu; IPro, PLLC

(57) ABSTRACT

A micro-electro-mechanical system (MEMS) microphone device is provided in the present disclosure. The MEMS microphone device includes a first electromagnetic shielding cover defining a first accommodating space; a second electromagnetic shielding cover received in the first accommodating space and defining a second accommodating space; a MEMS chip and an application specific integrated circuit (ASIC) chip received in the second accommodating space. The first electromagnetic shielding cover and the second electromagnetic shielding cover cooperatively provide dual electromagnetic shielding protection for the MEMS chip and the ASIC chip.

16 Claims, 2 Drawing Sheets

MEMS MICROPHONE DEVICE

FIELD OF THE DISCLOSURE

The present disclosure generally relates to microphone technologies, and more particular, to a micro-electro-mechanical system (MEMS) microphone device with a high electromagnetic shielding performance.

BACKGROUND

Microphones are applied in various electronic products for converting sound into electrical signals. Compared with other types of microphones, a MEMS microphone is widely used by virtue of some advantages such as small size and low weight. However, because a MEMS microphone needs to receive sound in the air, the MEMS speaker device is apt to suffer electromagnetic interference of environmental electromagnetic waves. This may decrease sound reception quality of the MEMS speaker device.

Therefore, it is desired to provide a MEMS microphone device which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
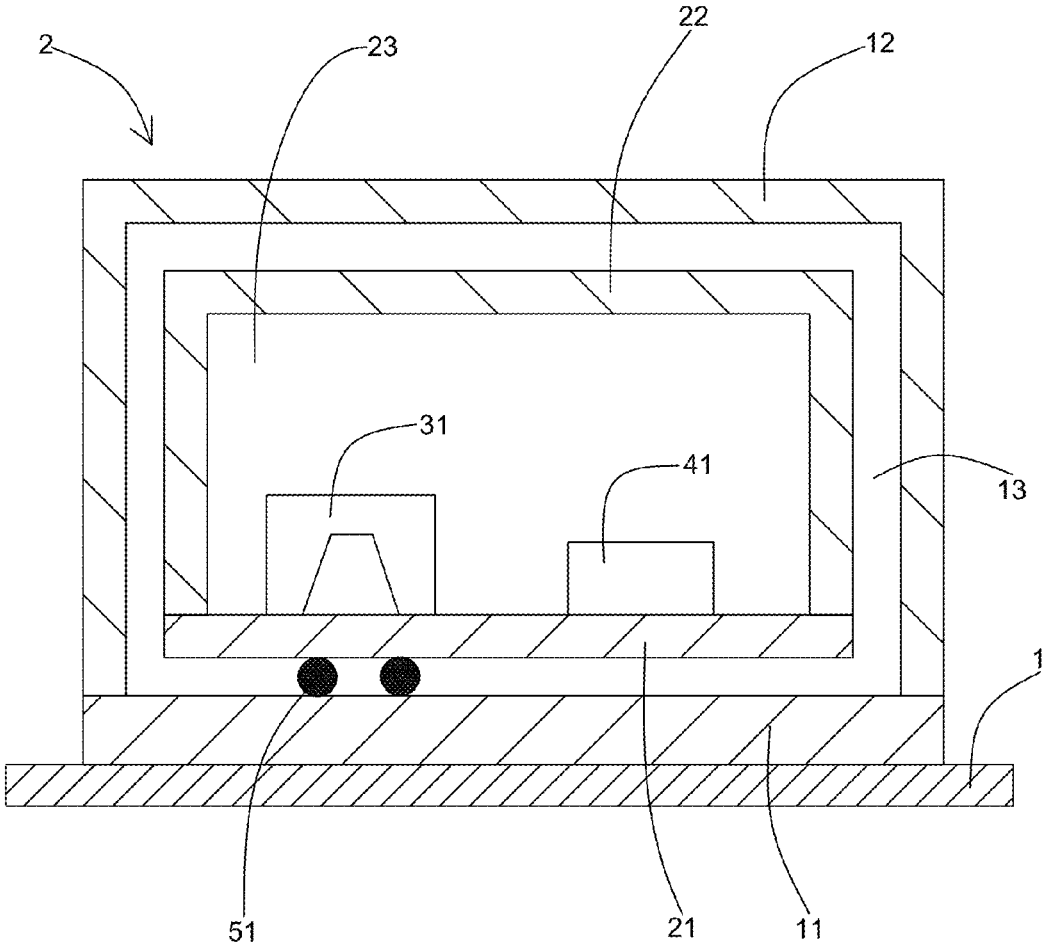
FIG. 1 is a schematic, cross-sectional view of a MEMS microphone device according to an embodiment of the present disclosure.

The present disclosure will be described in detail below with reference to the attached drawings and the embodiment thereof FIG. 1 is a schematic, cross-sectional view of a MEMS microphone device according to an embodiment of the present disclosure. The MEMS microphone device may be applied in a smart phone, a tablet computer, or other types of electronic apparatus. The MEMS microphone device includes a main board 1 and a MEMS microphone module 2 installed on the main board 1. The MEMS microphone module 2 includes a first circuit board 11, a first electromagnetic shielding cover 12, a second circuit board 21 and a second electromagnetic shielding cover 22.

The first circuit board 11 is disposed on and electrically connected to the main board 1. The first electromagnetic shielding cover 12 is engaged with the first circuit board 11 to form a first accommodating space 13. The second circuit board 21 and the second electromagnetic shielding cover 22 are received in the first accommodating space 13.

The second electromagnetic shielding cover 22 is engaged with the second circuit board 21 to form a second accommodating space 23. The second circuit board 21 is electrically connected to the first circuit board 11; for example, in the present embodiment, the second circuit board 21 is electrically connected to the first circuit board 11 via conductive material 51 such as conductive glue.

Moreover, the MEMS microphone module 2 may further include a MEMS chip 31 and an application specific integrated circuit (ASIC) chip 41. The MEMS chip 31 and the ASIC chip 41 are both received in the second accommodating space 23, and are electrically connected to the second circuit board 21.

The first electromagnetic shielding cover 12 and the second electromagnetic shielding cover 22 are both adapted to provide electromagnetic shielding protection for electrical components therein. In exemplary embodiments, the second electromagnetic shielding cover 22 may have a same configuration as the first electromagnetic shielding cover 12.

Both of the first electromagnetic shielding cover 12 and the second electromagnetic shielding cover 22 may be metal covers which per se have electromagnetic shielding capability. In an alternative embodiment, each of the first electromagnetic shielding cover 12 and the second electromagnetic shielding cover 22 may be a plastic cover with an electromagnetic shielding layer or an electromagnetic shielding circuit. For example, the electromagnetic shielding layer may be a metal layer electroplated on an outer surface of the plastic cover, or embedded within the plastic cover; when the electromagnetic shielding circuit is adapted, the electromagnetic shielding circuit may be formed on an inner surface of the plastic cover.

To further improve the electromagnetic shielding performance of the MEMS microphone device, in the present embodiment the first electromagnetic shielding cover 12 and the second electromagnetic shielding cover 22 may be grounded via the first circuit board 11 and the second circuit board 22 respectively. Alternatively, since the first circuit board 12 and the second circuit board 22 are electrically connected with each other, in other embodiments, it is also feasible to make only one of the first electromagnetic shielding cover 12 and the second electromagnetic shielding cover 22 be grounded via the corresponding one of the first circuit board 12 and the second circuit board 22.

In the MEMS microphone device as provided in the present disclosure, because the MEMS chip 31 and the ASIC chip 41 are received in the second accommodating space 23 formed by the second electromagnetic shielding cover 22, and are further received in the first accommodating space 13 formed by the first electromagnetic shielding cover 12 together with the second electromagnetic shielding cover 22, in the present disclosure, the MEMS chip 31 and the ASIC chip 41 can get dual protection from suffering electromagnetic interference of surrounding electromagnetic waves. This can ensure the MEMS microphone device to have good sound reception quality.

Figure 2:
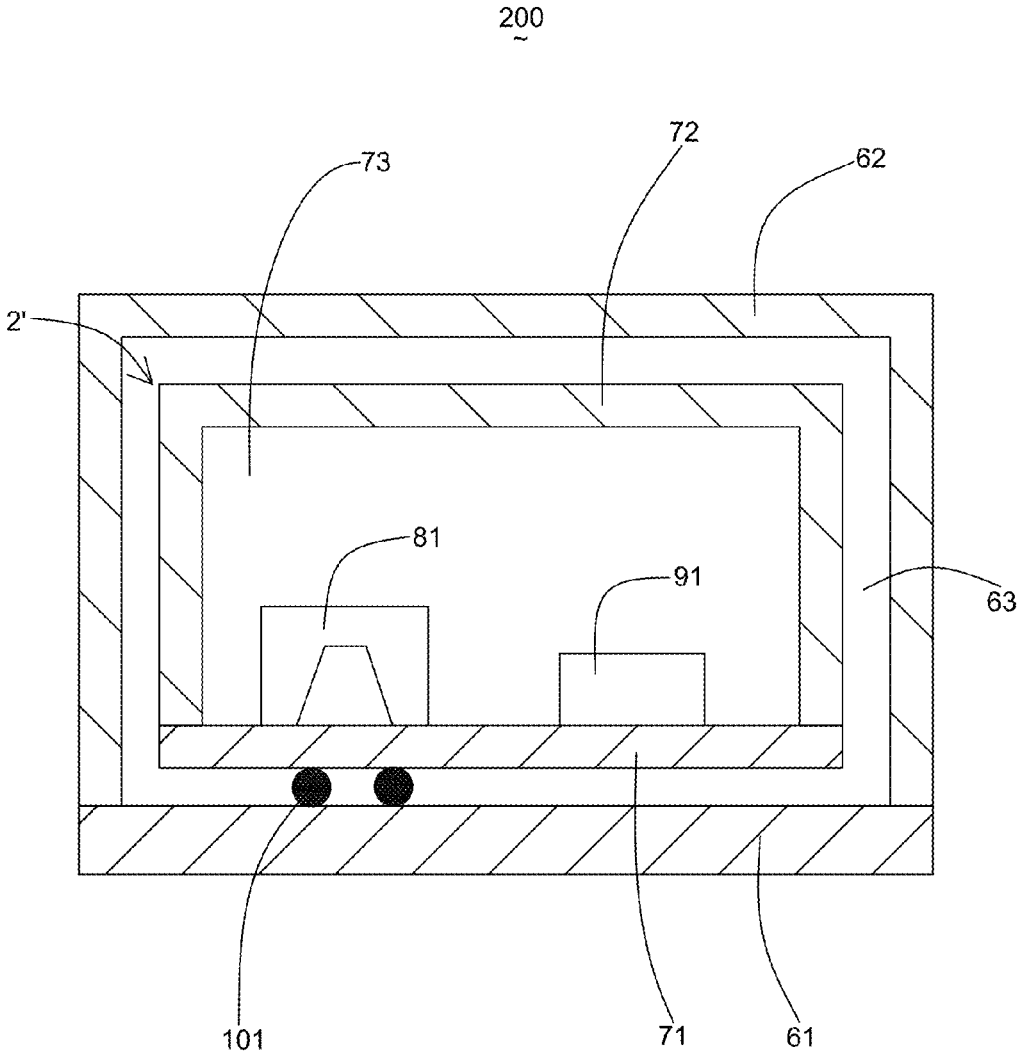
FIG. 2 is a schematic, cross-sectional view of a MEMS microphone device according to another embodiment of the present disclosure.

In other embodiments, the first circuit board 11 may be integrated into the main board 11. Referring to FIG. 2, a MEMS microphone device 200 according to another embodiment is shown, the MEMS microphone device 200 is similar to the above-described MEMS microphone device as illustrated in FIG. 1, but mainly differs in that a main board 61 of the MEM microphone device 200 incorporates the first circuit board 11 of the MEMS microphone device as illustrated in FIG. 1.

Specifically, the MEMS microphone device 200 also includes a main board 61, a first electromagnetic shielding cover 62 and a MEMS microphone module 2'. The first electromagnetic shielding cover 62 is s engaged with the main board 61 to form a first accommodating space 63, and the first electromagnetic shielding cover 62 may be grounded via the main board 31.

The MEMS microphone module 2' is received in the first accommodating space 63, and the MEMS microphone module 2' includes a circuit board 71 and a second electromagnetic shielding cover 72, a MEMS chip 81 and an ASIC chip 91.

The second electromagnetic shielding cover 72 is engaged with the circuit board 71 to form a second accommodating space 73, and the second electromagnetic shielding cover 72 may be grounded via the circuit board 71; moreover, the circuit board 71 is electrically connected to the main board 61 via conductive material 101 such as conductive glue. The MEMS chip 31 and the ASIC chip 41 are both received in the second accommodating space 73, and are electrically connected to the circuit board 71.

In the MEMS microphone device 200 as provided in the present embodiment, although no independent first circuit board is included, the MEMS chip 31 and the ASIC chip 41 can still get dual protection from suffering electromagnetic interference by the first electromagnetic shielding cover 62 and the second electromagnetic shielding cover 62.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro-electro-mechanical system (MEMS) microphone device, comprising:

a first electromagnetic shielding cover defining a first accommodating space and having a plurality of sidewalls and an upper wall connecting with the sidewalls;

a second electromagnetic shielding cover received in the first accommodating space and having a plurality of sidewalls and an upper wall connecting with the sidewalls, the sidewalls and the upper wall of the second electromagnetic shielding cover separated from that of the first electromagnetic shielding cover, the second electromagnetic shielding cover defining a second accommodating space; and a MEMS chip and an application specific integrated circuit (ASIC) chip received in the second accommodating space;

wherein the first electromagnetic shielding cover and the second electromagnetic shielding cover cooperatively provide dual electromagnetic shielding protection for the MEMS chip and the ASIC chip.

2. The MEMS microphone device of claim 1, further comprising a first circuit board, wherein the first electromagnetic shielding cover is engaged with the first circuit board to define the first accommodating space.

3. The MEMS microphone device of claim 2, further comprising a second circuit board, wherein the second electromagnetic shielding cover is engaged with the second circuit board to define the second accommodating space.

4. The MEMS microphone device of claim 3, wherein the second circuit board is electrically connected to the first circuit board via conductive material.

5. The MEMS microphone device of claim 4, wherein at least one of the first electromagnetic shielding cover and the second electromagnetic shielding cover is grounded via a corresponding one of the first circuit board and the second circuit board.

6. The MEMS microphone device of claim 4, wherein the first electromagnetic shielding cover and the second electromagnetic shielding cover are grounded via the first circuit board and the second circuit board respectively.

7. The MEMS microphone device of claim 3, further comprising a main board, wherein the first circuit board is disposed on the main board and electrically connected to the main board.

8. The MEMS microphone device of claim 1, further comprising a main board, wherein the first electromagnetic shielding cover is engaged with the main board to define the first accommodating space.

9. The MEMS microphone device of claim 8, further comprising a main board, wherein the second electromagnetic shielding cover is engaged with the circuit board to define the second accommodating space.

10. The MEMS microphone device of claim 9, wherein the second circuit board is electrically connected to the main board via conductive material.

11. The MEMS microphone device of claim 10, wherein the first electromagnetic shielding cover and the second electromagnetic shielding cover are grounded via the main board and the circuit board respectively.

12. The MEMS microphone device of claim 1, wherein both the first electromagnetic shielding cover and the second electromagnetic shielding cover are metal covers.

13. The MEMS microphone device of claim 1, wherein each of the first electromagnetic shielding cover and the second electromagnetic shielding cover is a plastic cover with an electromagnetic shielding layer.

14. The MEMS microphone device of claim 13, wherein the electromagnetic shielding layer is a metal layer electroplated on an outer surface of the plastic cover.

15. The MEMS microphone device of claim 13, wherein the electromagnetic shielding layer is a metal layer embedded within the plastic cover.

16. The MEMS microphone device of claim 1, wherein each of the first electromagnetic shielding cover and the second electromagnetic shielding cover comprises a plastic cover and an electromagnetic shielding circuit, the electromagnetic shielding circuit is formed on an inner surface of the plastic cover.

* * * * *